United States Patent [19]

Schuessler et al.

[11] 4,134,090

[45] Jan. 9, 1979

[54] ELECTROMAGNETIC ACTUATOR FOR A RELAY

[75] Inventors: John C. Schuessler, West Covina; Marvin G. Nelsen, Irvine; David J. Tapp, Manhattan Beach, all of Calif.

[73] Assignee: Leach Corporation, Los Angeles, Calif.

[21] Appl. No.: 844,470

[22] Filed: Oct. 21, 1977

Related U.S. Application Data

[63] Continuation-in-part of Ser. No. 669,217, Mar. 22, 1976, abandoned.

[51] Int. Cl.[2] ..... H01F 7/08

[52] U.S. Cl. ..... 335/229; 335/274

[58] Field of Search ..... 335/229, 230, 234, 274, 335/78, 81, 84

[56] References Cited

U.S. PATENT DOCUMENTS

| | | | |
|---|---|---|---|
| 2,941,130 | 6/1960 | Fischer et al. | 335/230 |
| 3,317,871 | 5/1967 | Adams | 335/230 |
| 3,968,470 | 7/1976 | Brown | 335/230 |

*Primary Examiner*—George Harris

*Attorney, Agent, or Firm*—Christie, Parker & Hale

[57] ABSTRACT

An electromagnetically operated relay in which an elongated armature is pivotally supported adjacent three pole members. One pole member has a surface adjacent one end of the armature. The second pole member has a surface adjacent the armature on the opposite side of the pivot from the first pole member. The third pole member has an elongated surface extending on either side of the second pole member between the outer end of the armature and the pivot. A permanent magnet is connected in a low reluctance magnetic path between the second and third pole members to produce a permanent field biasing the armature toward the second and third pole members. An electromagnet connected in the low reluctance magnetic path between the first and second pole members, when energized from a direct current source, increases the level of flux in the first and third pole members and decreases the level of flux in the second pole member, causing the armature to pivot toward the first pole member.

19 Claims, 10 Drawing Figures

ELECTROMAGNETIC ACTUATOR FOR A RELAY

CROSS-REFERENCE TO RELATED APPLICATION

This application is a continuation-in-part of application Ser. No. 669,217, filed Mar. 22, 1976 now abandoned.

FIELD OF THE INVENTION

This invention relates to electromechanical relays, and more particularly, to a relay which utilizes a permanent magnet to bias the relay to the "Off" position.

BACKGROUND OF THE INVENTION

In the conventional relay, an electromagnet is used to bias an armature from its normally "Off" position to its "On" position. Pivoting of the armature operates appropriate switch contacts. When the electromagnet is de-energized, a spring is generally used to return the armature to its "Off" position. However, to provide relays which are acceptable for use in the aerospace industry, high contact pressures and low contact bounce as well as the ability to withstand vibration and high G-forces are required, giving rise to relay designs which prohibit the use of return springs, Instead, permanent magnets have been used to secure the armature and contacts in the "Off" position. Such a relay, for example, is described in detail in U.S. Pat. No. 3,484,729, assigned to the same assignee as the present invention. This relay utilizes a magnetic circuit design described in U.S. Pat. No. 3,317,871, also assigned to the assignee of the present invention. The relay described in these patents utilizes a permanent magnet to provide a high holding force to retain the armature in its normal de-energized position and yet permits the armature to rotate rapidly in response to the magnetic force produced by an electromagnet when energized. The permanent magnet pulls the armature back to the "Off" position when the electromagnet is de-energized. However, the magnetic circuit utilized in these relays requires one end of the armature to move in the gap between poles of the permanent magnet in going from the "Off" to the "On" position. Since the moving contacts must be mounted on one side of the armature, the positioning of magnetic poles on both sides of the armature at one end produce mechanical problems in mounting the contacts so that movement of the contacts with rotation of the armature remains clear of the pole pieces. The addition of the third pole on the same end but the opposite side of the armature from the poles of the electromagnet makes it more difficult to obtain a compact overall design. The contacts instead of being directly mounted on the armature must be spaced substantially away from the armature, giving rise to the type of contact mounting problems to which U.S. Pat. No. 3,484,729 is directed.

SUMMARY OF THE INVENTION

The present invention is directed to an improved relay using a permanent magnet to return and hold the armature in the de-energized or "Off" position. The poles of the permanent magnet and the electromagnet are all positioned against the same surface of the armature so that the switch contacts can be mounted directly on the opposite surface of the armature, resulting in a substantially more compact design. While relays have heretofore been proposed utilizing permanent magnets in combination with electromagnets to actuate a relay in which all of the poles have been located against one surface of the armature such known realy designs have only been applicable to so-called "polarized" relays in which the electromagnet must be energized to switch the relay in either direction between its two stable states. Permanent magnets are used in such relays to lock the relay in either of its two stable positions when the electromagnet is de-energized. See for example U.S. Pat. Nos. 2,941,130 and 2,960,583.

Unlike the polarized relay of the types shown in these patents, the present invention is directed to a relay which is retained in a normally de-energized position by a permanent magnet but switches to its energized or "On" position by the energizing of the electromagnet. The relay of the present invention must return to its "Off" position whenever the electromagnet is de-energized. Not only must the field of the electromagnet counter the flux from the permanent magnet with a minimum of energy to cause the armature to move from the "Off" position to the "On" position, but when de-energized, the flux from the permanent magnet must not cause the armature to latch in the "On" position. The present invention provides a magnetic circuit in which flux flowing through the armature and core never changes direction in changing between the energized and de-energized conditions. The flux is merely caused to increase at one end of the armature while decreasing at the other end. By the present invention, a relay design is provided which results in a more compact and simplified mechanical design. Greater clearance for electrical contacts is provided together with improved clearance for the electrical contacts, reducing the chance for arcing or other malfunction. Improved access to the magnetic air gaps for inspection, adjustment, and cleaning is achieved without sacrifice in the level of contact pressure which can be maintained.

This is accomplished in brief by providing a relay design in which an elongated armature is pivotally supported adjacent a magnetic actuator which includes three pole members all located adjacent the same surface of the armature. A first one of the pole members has a surface adjacent one end of the armature, while a second one of the pole members has a surface adjacent the armature on the opposite end of the armature from the first pole member with the armature pivoted between he ends. A third pole member has an elongated surface adjacent the armature extending on either side of the second pole member between the outer end of the armature and the pivot. The first and second pole members are joined by a core on which is wound the electromagnetic coil, while the second and third pole members are joined by a permanent magnet. The flux of the permanent magnet passes between the second and third pole members through the armature on one side of the pivot, thus holding the armature against but not necessarily touching the second and third pole members in the normally "Off" position. When the coil is energized, flux fron the electromagnet is added to the permanent magnet, forming a flux path extending between the first and third pole members through the armature, while substantially cancelling any flux between the armature and the second pole member, thereby causing the armature to move toward the first pole member.

DESCRIPTION OF THE DRAWINGS

For a more complete understanding of the invention, reference should be made to the accompanying drawings, wherein.

DETAILED DESCRIPTION

Figure 1:
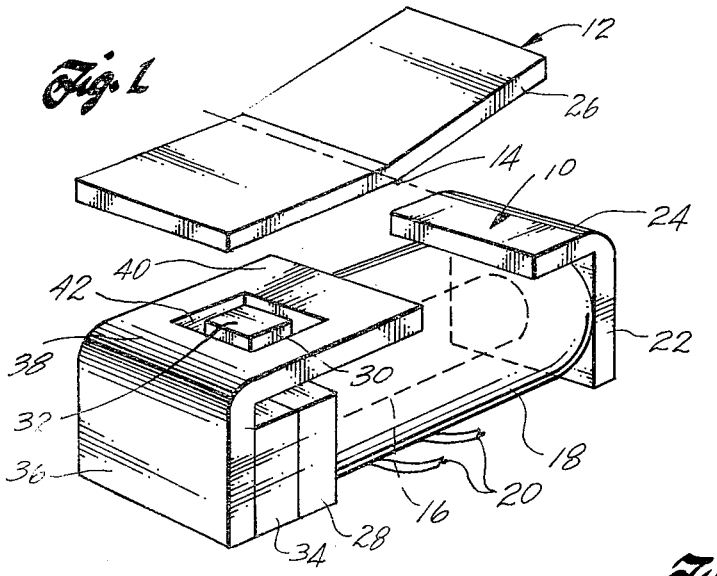
FIG. 1 is a simplified perspective view of one embodiment of the relay actuator of the present invention.
Figure 2:
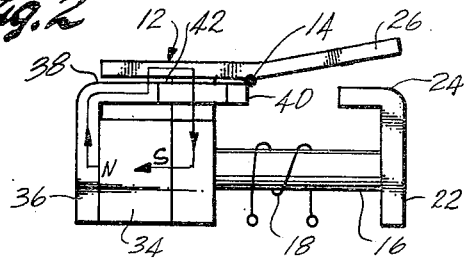
FIG. 2 is a simplified side elevational view of the relay actuator in the de-energized condition.
Figure 3:
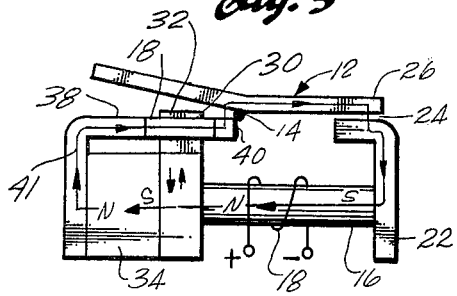
FIG. 3 is similar to FIG. 2 but with the relay in the energized condition.

Referring to the drawings in detail, and with particular reference to FIGS. 1–3, the numeral 10 indicates generally the magnetic actuator of a relay which has associated therewith an armature 12. The armature 12 is shown moved away from the actuator in FIG. 1 to expose the pole faces of the magnetic actuator. The armature 12 is pivoted for rotation about an axis 14 relative to the magnetic actuator 10.

The magnetic actuator includes an electromagnet having a core 16 extending substantially parallel to the armature 12. A winding 18 provides an energizing coil for the electromagnet, the winding being connected across a suitable direct current source (not shown) through input leads 20 to energize the relay. Connected to one end of the core 16 is a first pole member 22 which is L-shaped to form a pole face 24 extending approximately parallel to the core 16. The pole face 24 is adjacent one end 26 of the armature 12. A second pole member 28 is joined to the opposite end of the core 16 from the pole member 22. The pole member 28 has a narrow portion 30 projecting upwardly toward the armature and terminating in a pole face 32. The pole face 32 is positioned on the opposite side of the pivot 14 relative to the pole face 24 of the first pole member 22.

Positioned on the opposite side of the pole member 28 from the core 16 is a permanent magnet 34 in the form of a rectangular block. The permanent magnet is magnetically polarized in a direction parallel to the longitudinal axis of the core 16. A third pole member 36 is connected to the opposite face of the permanent magnet 34 from the pole member 28. The pole member 36 is also L-shaped to provide a pole face 38 lying along the armature and extending toward the pole face 24. The pole face 38 terminates at a point near the pivot 14, as indicated at 40. An opening 42 is provided in the pole face 38 through which the portion 30 of the second pole member 28 extends.

In operation, when the electromagnet is de-energized, most of the flux induced by the permanent magnet 34 in the pole members 28 and 36 extends across the gap between the pole face 38 and the armature surface and the pole face 32. The field across the gaps formed between the armature and the two pole faces 38 and 32 produces a force on the armature tending to rotate it in the counterclockwise direction, bringing the armature into firm contact with the pole face 32 of the second pole member 28. The armature is thus "locked" in the de-energized or "Off" position.

To energize the electromagnet, the winding 18 is connected across a direct current source (not shown). The direction of current flow in the winding 18 is such to induce flux flowing in the same direction as the flux induced by the permanent magnet 34. Thus the first and third pole members 22 and 36 remain magnetically polarized with the same polarity but at much higher levels of flux. The second pole member 28 has its flux level greatly reduced. The pole member 28 being magnetically centered becomes in effect magnetically neutral, that is, the flux from the permanent magnet 34 flowing into the second pole member 32 is nearly balanced by the magnetic flux from the electromagnet 16 and 18 tending to flow out of the second pole member. The flux path for the relay in the energized state is shown by the dash line 41 in FIG. 3. Thus, the flux extends across the gap between the inner edge 40 of the third pole member 36 and the armature 12 near the pivot 14, and then across the gap between the outer end 26 of the armature and the first pole member 22, thereby attracting the armature toward the pole face 24 in the energized or "On" condition. It will be seen that the direction of flux in the armature remains the same in both the de-energized and energized states. The level of flux greatly increases at one end of the armature while decreasing at the other end. Merely by energizing and de-energizing the electromagnet, the direction of torque on the armature is strongly reversed.

Figure 4:
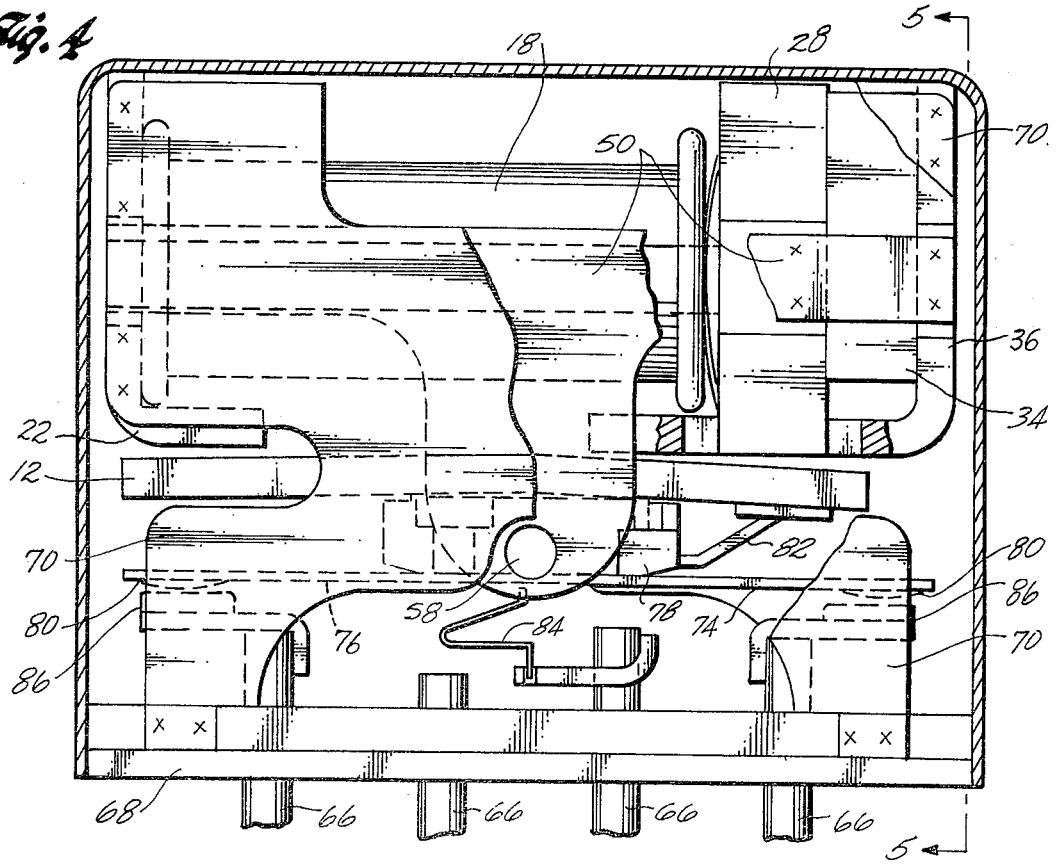
FIG. 4 is a detailed elevational view of a relay incorporating the features of the present invention.
Figure 5:
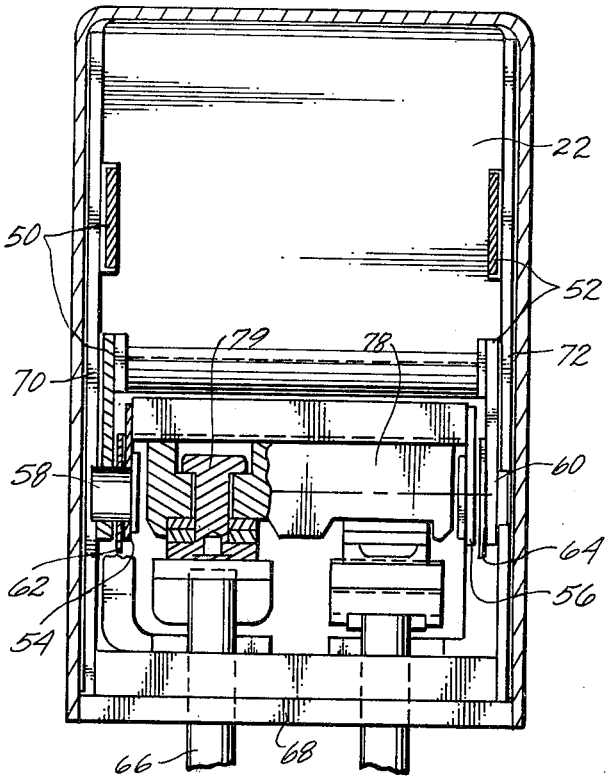
FIG. 5 is a cross-sectional view taken substantially on the line 5—5 of FIG. 4.

Referring to FIGS. 4 and 5 there is shown a preferred embodiment of the invention. After the electromagnet is assembled with the pole members 22 and 28 joined by the core 16 with the coil winding 18 mounted on the core between the pole members, a pair of pivot frame plates 50 and 52 are spotwelded or otherwise secured to the edges of the pole member. The pivot frame plates 50 and 52 are positioned in notches in the pole members so as to be flush with the edge surfaces of the pole members. The outer ends of the frame members 50 and 52 are secured to the third pole member 36 to anchor the third pole member 36 in fixed relation to the other pole members.

The pivot frame plates 50 and 52 provide pivotal support for the armature 12. To this end a pair of hinge plates 54 and 56 are secured to the sides of the armature 12 and project downwardly away from the magnetic actuator sub-assembly. The hinge plates 54 and 56 support a pair of axially aligned stub shafts 58 and 60 which project outwardly and are journaled in aligned holes in the pivot frame plates 50 and 52. Teflon washers 62 and 64 serve as side thrust bearing surfaces. The three pole members are associated magnets, frame plates 50 and 52, and pivotally supported armature 12, can be assembled as an integral unit. This construction permits the magnetic motor or actuator for the realy to be operated and tested as a unit before the rest of the relay assembly is completed.

It will be noted that the pole faces of the three pole members lie in a common plane. The pivotally supported armature 12 is not straight but slightly V-shaped. Thus when the armature pivots in one direction, the surface of the armature to one side of the pivot lies substantially flat against the pole faces of the pole members 28 and 36 while forming a substantial gap at the face of the pole member 22. When the armature 12 is rotated in the opposite direction, the other end of the armature comes in contact with the surface 24 of the pole member 22 over a substantial area. The surface of the armature may be coated or plated with a protective film of nonmagnetic material which not only acts to protect the ferrous metal of the armature against corrosion or rust, but also to reduce the effect of residual flux by maintaining small nonmagnetic gaps between the armature and the pole faces.

Electrical terminals, indicated generally at 66, extend through glass insulator seals in a base plate 68 to provide external electrical connections. A pair of side plates 70 and 72 provide rigid support between the base plate 68 and the magnetic actuator subassembly. Two of the terminals 66 are connected to the coil winding 18 of the electromagnet, while the remaining electrical terminals 66 are electrically connected to the contacts of a double-pole, double-throw switch operated by rotation of the armature 12. The switch includes a pair of spring fingers 74 and 76 which are supported from the armature 12 by an insulator block 78. The spring fingers 74 and 76 are anchored to the insulator block 78 by rivets 79. The insulation block is clamped to the armature 12 by cantilever springs 82 anchored to the armature and engaging notches in the block. The ends of the spring fingers 74 and 76 project outwardly from the insulator block 78 in cantilever fashion and terminate in electrical contacts 80 at their outer ends. Two of the electrical terminals 66 are electrically connected respectively to the spring fingers 74 and 76 through U-shaped springs 84. Four of the posts 66 support fixed contacts 86, which make and break contact with respective ones of the moving contacts 80 in conventional manner.

In FIGS. 4 and 5, the armature 12 is shown in a neutral position for clarity but normally the armature would be drawn against the pole faces of the pole members 28 and 36 by the permanent magnet 34. Thus the left-hand set of contacts as viewed in FIG. 4 are normally closed, while the right-hand set of contacts are normally open. Since the contacts are opened and closed by the pivoting action of the armature 12, there is a wiping action between the contacts 80 and 86. Furthermore the spring fingers 74 are deflected to insure good contact pressure. The spring action of the spring fingers 74 and 76 also operates to move the armature toward the pole members 28 and 36 when the coil winding is de-energized, thereby overcoming any tendency of the armature to remain latched in the "On" position because of residual flux from the magnets.

Figure 6:
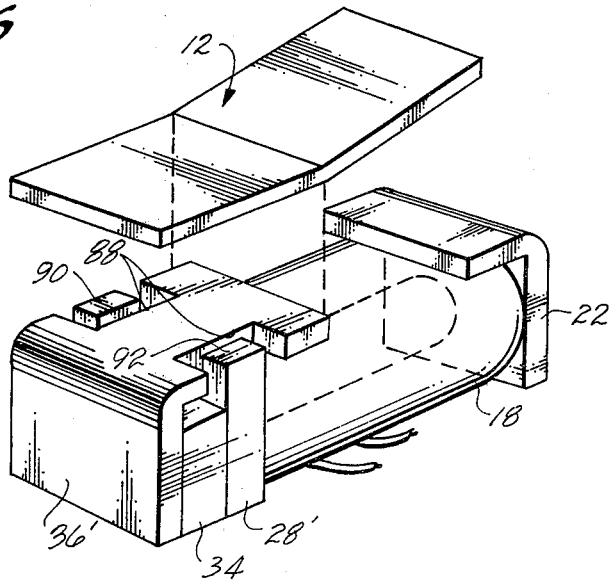
FIG. 6 is a simplified perspective view of an alternative embodiment of the present invention.

FIG. 6 shows an alternative embodiment of the magnetic actuator in which the second pole member 28' has two projecting portions 90 and 92 extending toward the armature through notches 88 formed in either edge of the third pole member 36'. The construction and operation of the modification of FIG. 6 is otherwise identical to that described in FIG. 1.

Figure 7:
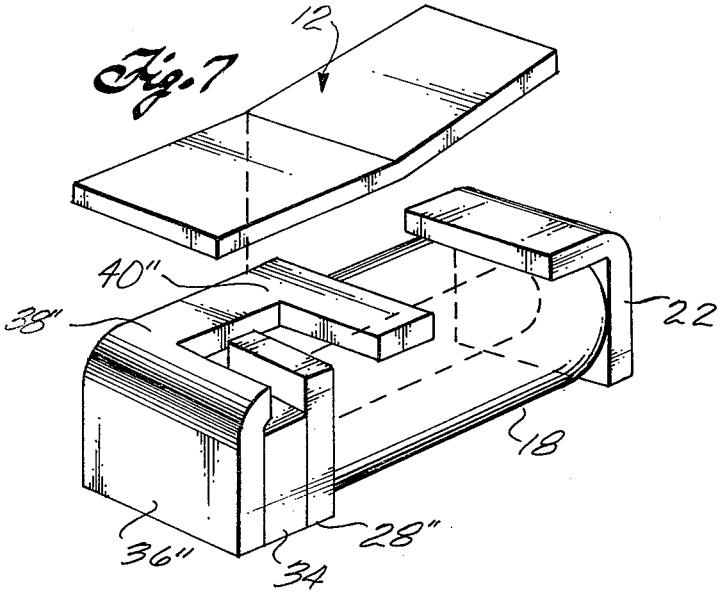
FIG. 7 is a simplified perspective view of a further alternative embodiment of the present invention.

A further embodiment is shown in FIG. 7 in which the second pole member 28'' has a single projecting portion which is positioned to one side of the pole face of the third pole member 36''. Construction and operation is otherwise substantially identical to that described in connection with FIG. 1. The pole face 38'' of the pole member 36'' may include a portion 40'' that extends the full width of the armature.

Figure 8:
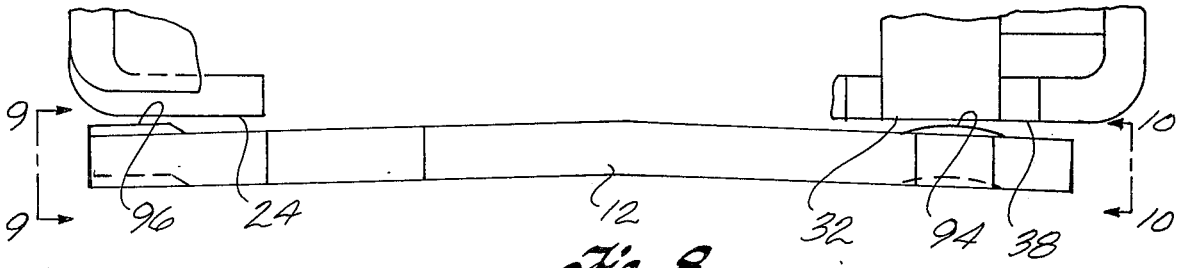
FIG. 8 is a fragmentary elevational view similar to FIG. 4 showing a preferred embodiment of the invention.

To provide a balanced relay in which the contact pressure in both the open and closed condition of the relay is substantially the same, it has been found desirable to limit the force produced on the armature by the permanent magnet by limiting the area of contact between the armature and the two pole members associated with the permanent magnet. In the arrrangements of FIGS. 1, 2, and 3, for example, the pole face 32 projects above the plane of the pole face 38 so that an air gap is maintained between the armature and the pole face 38, thus limiting the maximum force produced by the permanent magnet on the armature. In the preferred embodiment shown in FIGS. 8, 9, and 10, the pole faces 32 and 38 lie in a common plane. However, as shown in FIGS. 8 and 10, the armature 12 has a substantially spherically shaped dimple 94 pressed or otherwise formed adjacent one end of the armature. The position on the armature of the dimple 94 is such as to make contact with the pole face 32 while maintaining a gap between the surface of the armature 12 and the pole face 38. The spherical surface makes substantially a point contact with the pole face 32.

Figure 9:
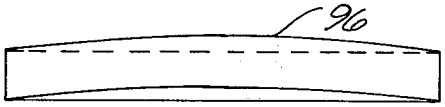
FIG. 9 is an end view taken at the line 9—9 of FIG. 8 showing detail of the armature construction.
Figure 10:
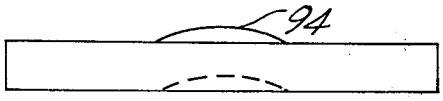
FIG. 10 is an end view taken on the line 10—10 of FIG. 8 showing detail of the other end of the armature.

The other end of the armature adjacent the pole face 24, in the preferred embodiment of FIGS. 8, 9, and 10, is shaped or curved slightly in a transverse direction to form an arc of a cylinder, as best shown in FIG. 9. Thus when the armature 12 rotates in a direction toward the pole face 24, the arcuate portion 96 of the armature 12 makes substantially a line contact with the center of the pole face 24. This acts to increase slightly the reluctance of the interface between the armature 12 and the pole face 24, thus controlling the maximum force holding the armature against the pole face 24. It also reduces any force opposing the switching of the relay as the result of any residual flux when the electromagnet is de-energized.

In each of the embodiments, it will be recognized that the pole face of the third pole member is elongated and terminates adjacent the pivot point of the armature. By this arrangement, the third pole member serves as a low reluctance path for the flux passing to pole faces 32 and 24 at each end of the armature. In the basic embodiment, flux through pole face 32 creates the main pull force to retain the armature in the counterclockwise position when the electromagnet is de-energized, and flux through pole face 24 creates the main pull force to retain the armature in the clockwise position with the electromagnet energized. However, in some embodiments, the design could be made to have nearly equal pull forces from both the second and third pole faces in the de-energized condition.

What is claimed is:

1. A relay comprising a magnetic actuator and an elongated armature pivotally supported between the ends relative to the actuator, whereby the ends of the armature move in opposite directions when the armature is pivoted, the actuator including three pole members, each pole member having a magnetic pole-defining surface adjacent the armature through which lines of magnetic flux pass between the pole and the armature, the three pole defining surfaces being positioned on the same side of the armature, a first one of the pole members having said pole-defining surface adjacent one end of the armature, a second one of the pole members having said pole-defining surface adjacent the armature on the opposite side of the pivot from the first pole member, and a third one of the pole members having said pole-defining surface adjacent the armature extending lengthwise of the armature on either side of the second pole member between the outer end of the armature and the pivot, whereby pivotal movement of the armature away from the pole-defining surface of the first pole member is toward the pole-defining surfaces of the second and third pole members, a permanent magnet connected in a low reluctance magnetic path between the second and third pole members, and an electromagnet connected in a low reluctance magnetic path between the first and second pole members, the armature when pivoted to a first position reducing the reluctance of the flux path between the first and third pole members and when pivoted to a second position reducing the reluctance of the flux path between the second and third pole members.

2. The relay of claim 1 wherein the electromagnet when energized from a source of direct current is polarized to increase the level of flux in the first and third pole members and decrease the level of flux in the second pole member.

3. The relay of claim 2 wherein the third pole member has an opening through which the second pole member extends.

4. The relay of claim 3 wherein the opening forms a gap between the second and thrid pole members that is greater than the gap between the said surface of the second and third pole members and the adjacent surface of the armature when pivoted toward the said second position.

5. The relay of claim 3 wherein the opening is in the form of a hole in the third pole member with the second pole member extending through the hole.

6. The relay of claim 3 wherein the opening is in the form of a pair of notches on the margins of the third pole member, the second pole member having portions extending through said notches.

7. Apparatus of claim 1 wherein the pole surface of the second pole member projects beyond the surface of the third pole member toward the armature to contact the armature and form a gap between the armature and the third pole member when the armature is rotated toward the second and third pole members.

8. Apparatus of claim 1 wherein the pole-defining surfaces of the second and third pole members lie in a common plane, and the surface of the armature adjacent said surface includes a portion projecting toward the pole-defining surface of the second pole member, the projecting portion contacting the second pole member while maintaining a gap between the armature and the pole surface of the third pole member when the armature rotates toward the pole surfaces of the second and third pole members.

9. Apparatus of claim 8 wherein the projecting portion is formed as a spherical dimple in the armature.

10. Apparatus of claim 1 wherein the armature includes a portion projecting toward the pole-defining surface of the first pole member.

11. Apparatus of claim 8 wherein the armature includes a portion projecting toward the pole-defining surface of the first pole member.

12. Apparatus of claim 11 wherein the portion projecting toward the first pole member is formed by forming the adjacent end of the armature in a cylindrical arc.

13. A magnetic actuating device for a relay or the like comprising an electromagnet including a core, a winding on the core, and first and second pole members at either end of the core, an elongated armature pivotally supported intermediate the ends thereof, the first and second pole members having pole faces positioned adjacent opposite ends of the armature opposite the same side of the armature such that rotation of the armature about the pivot moves one end of the armature toward one pole face and the other end of the armature away from the other pole face, a permanent magnet having one pole in contact with the second pole member, and a third pole member in contact with the other pole of the permanent magnet, the third pole member having a pole face, a first portion of the pole face of the third pole member being adjacent the armature between said face of the second pole member and the pivot and a second portion of the pole face of the third pole member being adjacent the armature between said face of the second pole member and the end of the armature remote from the first pole member, whereby rotation of the armature about said pivot moves the armature away from the pole face of the first pole member toward the pole faces of the second and third pole members.

14. The actuator of claim 13 wherein the electromagnet when energized is polarized such that the first pole member is of opposite polarity from the third pole member.

15. The apparatus of claim 13 further including a pair of frame plates secured to all of the pole members, the pole members holding the plates in spaced parallel relationship, the pole members and frame plates forming an integral structure, a portion of each of the frame plates extending toward the armature, and means engaging said portions of the frame plates for pivotally supporting the armature between said portions.

16. Apparatus of claim 13 wherein a portion of the armature adjacent the pole face of the second pole member projects toward the pole face, making contact with the second pole member while maintaining a gap between the armature and the third pole member when the armature rotates toward the second and third pole members.

17. Apparatus of claim 16 wherein the armature includes a portion projecting toward the pole face of the first pole member.

18. A motor for a relay comprising a magnet structure including three pole members of magnetic material, the pole members having spaced parallel portions, a pair of parallel spaced frame plates secured respectively to opposite sides of the parallel portions of the pole members to anchor the pole members in fixed relation to each other, an armature, and means pivotally supporting the armature between the frame plates adjacent the pole members for rotation of the armature about an axis perpendicular to said frame plates, the pole members having pole faces lying adjacent a common surface of the armature, said common surface moving toward and away from said pole faces with rotation of the armature about said axis, the pole faces of two of the pole members being positioned to one side of said axis and the pole face of the third pole member positioned on the other side of said axis, the pole face of a first one of said two of the pole members extending on either side of the pole face of a second one of said two pole members, such that positions of the pole face of the first pole member extend nearer to and further from the pivot than the pole face of the second pole member.

19. Apparatus of claim 18 wherein the magnet structure further includes an electromagnet having a magnetic core and a winding on the core, the core extending between two of said pole members, and a permanent magnet positioned between two of said pole members, only one of which is common to the core of the electromagnet, the permanent magnet being positioned between said two of the pole members having pole faces on the same side of the pivot axis of the armature.

* * * * *